US007267608B2

(12) United States Patent
Kramer

(10) Patent No.: US 7,267,608 B2
(45) Date of Patent: Sep. 11, 2007

(54) METHOD AND APPARATUS FOR CONDITIONING A CHEMICAL-MECHANICAL POLISHING PAD

(75) Inventor: Stephen J. Kramer, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/728,526

(22) Filed: Dec. 5, 2003

(65) Prior Publication Data

US 2004/0116051 A1 Jun. 17, 2004

Related U.S. Application Data

(62) Division of application No. 09/943,774, filed on Aug. 30, 2001, now Pat. No. 7,037,177.

(51) Int. Cl.

| | |
|---|---|
| ***B24B 21/18*** | (2006.01) |
| ***B24B 33/00*** | (2006.01) |
| ***B24B 47/26*** | (2006.01) |
| ***B24B 55/00*** | (2006.01) |

(52) U.S. Cl. ..... 451/444; 451/28; 451/27; 451/30; 451/56; 451/443; 451/446; 451/526; 451/532; 451/536; 451/539

(58) Field of Classification Search ..... 451/28, 451/29, 30, 56, 443, 446, 526, 532, 536, 451/539

See application file for complete search history.

(56) References Cited

U.S. PATENT DOCUMENTS

| | | | | |
|---|---|---|---|---|
| 4,132,534 | A * | 1/1979 | Valdsaar | 51/307 |
| 4,232,059 | A * | 11/1980 | Proffitt | 427/96 |
| 4,475,983 | A | 10/1984 | Bader et al. | |
| 5,154,021 | A | 10/1992 | Bombardier et al. | |
| 5,216,843 | A | 6/1993 | Breivogel et al. | |
| 5,399,234 | A | 3/1995 | Yu et al. | |
| 5,667,541 | A * | 9/1997 | Klun et al. | 51/298 |
| 5,782,675 | A | 7/1998 | Southwick | |
| 5,851,138 | A | 12/1998 | Hempel, Jr. | |
| 5,868,608 | A | 2/1999 | Allman et al. | |
| 5,885,147 | A | 3/1999 | Kreager et al. | |
| 5,890,951 | A | 4/1999 | Vu | |
| 5,913,715 | A * | 6/1999 | Kirchner et al. | 451/56 |
| 5,921,856 | A | 7/1999 | Zimmer | |
| 5,941,761 | A | 8/1999 | Nagahara et al. | |
| 5,941,762 | A | 8/1999 | Ravkin et al. | |

(Continued)

*Primary Examiner*—Lee D. Wilson
*Assistant Examiner*—Shantese McDonald
(74) *Attorney, Agent, or Firm*—TraskBritt

(57) ABSTRACT

A conditioner including abrasive elements for conditioning a polishing pad to be used in abrasive semiconductor substrate treatment processes, such as chemical-mechanical polishing or chemical-mechanical planarization processes. The abrasive elements are formed from a material that may be degraded or dissolved by at least one chemical that will not substantially degrade or dissolve a material of the polishing pad. The abrasive elements of the conditioner may be degraded or dissolved in at least one chemical that will not substantially degrade or dissolve a material of the polishing pad. Any residue or particles of, or from, the abrasive elements that stick to or become embedded in the polishing pad are removed therefrom by exposing the polishing pad to the at least one chemical so as to degrade or dissolve the residue or particles without substantially degrading or dissolving a material of the polishing pad.

55 Claims, 4 Drawing Sheets

U.S. PATENT DOCUMENTS 6,004,196 A 12/1999 Doan et al.
6,022,266 A 2/2000 Bullard et al.
6,027,659 A 2/2000 Billett
6,054,183 A * 4/2000 Zimmer et al. ..... 427/249.8
6,273,798 B1 8/2001 Berman
6,352,471 B1 * 3/2002 Bange et al. ..... 451/527
6,386,963 B1 5/2002 Kenji et al.
6,447,374 B1 9/2002 Sommer et al.
6,447,375 B2 9/2002 Yancey et al.
6,679,761 B1 1/2004 Sunahara et al.
6,935,928 B2 8/2005 Uchikura et al.
2001/0008828 A1 7/2001 Uchikura et al.

* cited by examiner

METHOD AND APPARATUS FOR CONDITIONING A CHEMICAL-MECHANICAL POLISHING PAD

CROSS-REFERENCE TO RELATED APPLICATION

This application is a divisional of application Serial No. 09/943,774, filed Aug. 30, 2001 now U.S. Pat. No. 7,037,177 issued May 2, 2006.

BACKGROUND OF THE INVENTION

1. Field of the Invention

The present invention relates generally to apparatus and to methods for conditioning pads that are used in chemical-mechanical polishing or chemical-mechanical planarization processes, both of which are referred to herein as "CMP" processes. Particularly, the present invention relates to apparatus and methods for conditioning CMP pads with little or no contamination of the pads. More particularly, the present invention relates to apparatus for conditioning CMP pads, as well as to methods that include use of the conditioning apparatus and removing contaminants left on the CMP pad by the conditioning apparatus following conditioning of a CMP pad.

2. Background of Related Art

Chemical-mechanical polishing and chemical-mechanical planarization are abrasive techniques that typically include the use of a combination of chemical and mechanical agents to planarize, or otherwise remove material from or planarize a surface of a semiconductor material substrate bearing devices under fabrication. A chemical component, typically a slurry that includes one or more oxidizers, abrasives, complexing agents, and inhibitors, oxidizes the surface of one or more material layers that are being polished or planarized (i.e., at least partially removed). A polishing pad, or CMP pad, is used with the slurry and, along with abrasives present in the slurry, effects mechanical removal of the layer or layers from the surface of the semiconductor device structure. It should be noted that abrasive-only polishing and planarization, e.g., without the use of active chemical agents to effect material removal, are becoming more prevalent due to environmental concerns. Thus, the term "CMP" as used herein encompasses such abrasive only methods and apparatus.

Conventional CMP pads are round, planar, and have larger dimensions than the semiconductor substrates (e.g., wafers or other substrates including silicon, gallium arsenide, indium phosphide, etc.) upon which the structures or layers to be polished have been formed. In polishing one or more layers of structures formed on a substrate, the substrate and the conventional CMP pad are rotated relative to one another, with the location of the substrate being moved continuously relative to the polishing surface of the pad so that different areas of the pad are used to polish one or more of the layers or structures formed on the substrate.

Another polishing format is the so-called "web" format, wherein the pad has an elongate, planar configuration. The web is moved laterally from a supply reel to a take-up reel so as to provide "fresh" areas thereof for polishing one or more layers or structures formed on a semiconductor substrate. A similar, newer, polishing format is the so-called "belt" format, wherein the pad is configured as a belt, or continuous loop, of polishing material. In both the "web" and "belt" formats, the semiconductor substrate is rotated upon being brought into contact with the pad. The pad is moved when a "fresh" polishing surface is needed or desired.

Conventional CMP pads are typically formed by forming the pad material into large cakes, which are subsequently skived, or sliced, to a desired thickness. Alternatively, CMP pads may be formed by injection molding processes. When injection molding processes are used to form CMP pads, a thicker, tougher skin may be formed on the exteriors of the pads, covering a pad material with the desired polishing characteristics. "Web" and "belt" format CMP pads may be formed by extrusion or other processes that have conventionally been used to form thick films.

In addition, following the formation of CMP pads, the surfaces thereof typically require conditioning to impart the CMP pads with sufficient surface roughness to trap slurry for effective polishing of a surface of a semiconductor substrate. Alternatively, as the exterior surface of a CMP pad may conceal interior portions thereof that have a structure that is desirable for use in polishing, a CMP pad may be conditioned to expose an interior region thereof. As another alternative, it may be desirable to alter features on the polishing surface of the pad prior to polishing one or more layers or structures on a semiconductor substrate with the pad.

A desired surface roughness of a CMP pad is usually imparted to the pad by a so-called "break-in" conditioning process following placement of the pad on a polishing tool. Conditioning is also used to remove slurry from a CMP pad polishing surface and to restore the desired surface texture or roughness and planarity to the polishing surface thereof after the pad has been used to polish semiconductor device structures. Typically, a pad is conditioned by dragging the same across a rough or abrasive pad conditioner, such as a diamond or diamond-on-metal conditioner. The pad conditioner may also remove surface irregularities (e.g., protrusions) from the CMP pad, improving the planarity of the pad. Conventionally, CMP pads have been conditioned by rotating one or both of the CMP pad and the pad conditioner relative to one another for time periods of twenty minutes or more. Conditioning is often effected using the same equipment that is used to rotate the CMP pad during polishing. As a result, conditioning may undesirably tie up the CMP equipment, as well as the equipment operator's attention, for long periods of time that could otherwise be used to polish semiconductor substrates. Moreover, conventional conditioning processes are sometimes ineffective.

A less effective conditioning method that may be employed includes the use of a particulate abrasive, typically silicon carbide or alumina, which is also referred to as corundum, to roughen the surface of a CMP pad. Abrasive fixtures, such as abrasive-coated papers, cloths, and rigid (e.g., steel, aluminum, or plastic) fixtures to roughen the surfaces of CMP pads are known. While these abrasive-coated conditioners inexpensively and reliably roughen and planarize CMP pads, the use of abrasive-coated conditioners is somewhat undesirable since the CMP pads may trap or become embedded with the abrasive particles. The particulate abrasive materials, such as alumina and silicon carbide, that are typically employed to roughen and planarize CMP pads are very inert and typically cannot be chemically removed from a CMP pad without damaging the pad. When one of these particulate abrasive conditioning materials is present on a CMP pad, the surface of a polished semiconductor device structure may be scratched or otherwise damaged by the abrasive conditioning materials. If an electrically conductive or organic layer that overlies an electrically insulative layer or structure is being partially removed or planarized by the CMP process, electrically conductive debris from the layer being planarized or otherwise removed may be trapped in the scratches, or otherwise damaged areas of the surface of the semiconductor device structure. Such trapped debris may subsequently cause electrical shorting of a fabricated semiconductor device. For example, if CMP processes are used to remove mask material and at least part of a conductively doped HSG silicon layer from an insulator at the surface of a stacked capacitor structure, conductive silicon particles may be trapped in voids or vugs comprising defects in the surface of the insulator and subsequently cause electrical shorting between adjacent containers of the stacked capacitor. These potentially damaging contaminants may remain even when a chemical material removal process, such as a wet or dry etch, follows the CMP process.

The art lacks teaching of a conditioning apparatus and method that may be used to efficiently condition a CMP pad without consuming valuable CMP process time and with which unwanted particulate abrasive contaminants may be substantially removed from the CMP pad.

SUMMARY OF THE INVENTION

The present invention includes a conditioner for CMP pads. The conditioner includes abrasive elements, such as particles, filaments, or other structures formed from a material that may be substantially chemically removed from a CMP pad without damaging the CMP pad or degrading the material or materials of the CMP pad. Such abrasive materials include, without limitation, crystalline silicon dioxide ($SiO_2$) (e.g., quartz) and metals, such as iron or iron-based materials (e.g., alloys such as steel), copper, nickel, tungsten, and the like. The abrasive material may be carried upon a substrate, such as paper, cloth, or a rigid fixture. Alternatively, the abrasive material may comprise filaments or wires, such as those in a brush. Of course, other types of abrasive elements and conditioning apparatus including these abrasive elements are also within the scope of the present invention.

Preferably, the inventive conditioner is used to condition a CMP pad prior to assembling same with polishing equipment, which is referred to herein as "preconditioning" the CMP pad. Thus, when the conditioner of the present invention is employed to condition CMP pads, the polishing equipment need not be tied up in pad-conditioning operations, but may more efficiently be used to polish semiconductor substrates. Alternatively, a conditioner incorporating teachings of the present invention may be used to condition a CMP pad while the CMP pad is assembled with polishing equipment. Conditioning continues until the pad is imparted with desired polishing surface characteristics, such as roughness and planarity.

Once a CMP pad is conditioned with a conditioner of the present invention and in accordance with teachings of the present invention, at least the conditioned region of the CMP pad is exposed to a liquid medium, such as an etchant, that will substantially remove from the CMP pad any residual abrasive material that is left on or embedded in the polishing surface of the conditioned CMP pad by the conditioner without substantially degrading or otherwise damaging the CMP pad.

The present invention also includes methods and systems for conditioning CMP pads by use of the conditioners of the present invention, as well as methods for fabricating the conditioners.

Other features and advantages of the present invention will become apparent to those of skill in the art through consideration of the ensuing description, the accompanying drawings, and the appended claims.

DETAILED DESCRIPTION OF THE INVENTION

Figure 1:
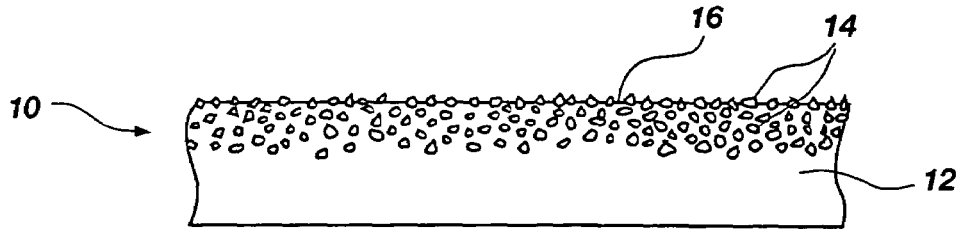
FIG. 1 is a cross-sectional schematic representation of a first embodiment of a conditioner incorporating teachings of the present invention, including a substantially rigid, polymeric supporting substrate and abrasive elements.

An exemplary embodiment of a conditioner 10 for conditioning CMP, or polishing, pads that incorporates teachings of the present invention is illustrated in FIG. 1. Conditioner 10 includes a supporting substrate 12 that carries abrasive particles 14, which are also referred to herein in some embodiments as abrasive elements.

Abrasive particles 14 are formed from a material that will facilitate conditioning of a CMP pad, but may be substantially removed from the conditioned surface of a CMP pad without substantially degrading or damaging the CMP pad. Stated another way, materials that may be dissolved or degraded by chemicals (e.g., wet etchants) that will not substantially degrade or damage a type of CMP pad to be conditioned are useful as abrasive particles.

For example, abrasive particles 14 may be formed from quartz, or crystalline silicon dioxide ($SiO_2$), since chemicals such as hydrofluoric acid (HF), sodium hydroxide (NaOH), and potassium hydroxide (KOH) degrade or dissolve quartz at a much faster rate than these chemicals degrade or dissolve the materials, such as polyurethane or other polymers, from which CMP pads are conventionally fabricated.

Thus, HF, NaOH, and KOH will not substantially degrade or dissolve a polyurethane or other polymer that may be used to form a CMP pad by the time the abrasive particles lodged on a surface thereof are dissolved.

As another example, abrasive particles 14 may be formed from iron (Fe) or an iron-containing material (e.g., steel, or other iron-containing alloys such as INVAR®), copper, nickel, tungsten, or another suitable metal. A degradant or solvent for such abrasive particle 14 materials which does not substantially degrade or dissolve the materials from which CMP pads are fabricated, may be used to remove any remaining abrasive particles 14 from a CMP pad. By way of example only, iron and iron-containing materials may be degraded or dissolved by hydrochloric acid, which does not substantially degrade or dissolve the materials, such as polyurethane, from which CMP pads are conventionally fabricated. As another example, nitric acid, phosphoric acid, sulfuric acid, other acids, and acid mixtures may be used to degrade or dissolve abrasive particles 14 of other materials or oxides thereof. Additives, such as oxidants (e.g., hydrogen peroxide ($H_2O_2$)), may also be used to facilitate the degradation and/or dissolution of abrasive particles 14.

Abrasive particles 14 may be of any suitable size and be located on a conditioning surface 16 of supporting substrate 12 in any density that will impart a polishing surface of a CMP pad with a desired, conditioned finish. By way of example only, abrasive particles 14 exhibiting a diameter or width dimension (if not spherical) of about 25 μm to about 500 μm will impart the desired characteristics to a polishing surface of a CMP pad. Materials that are useful as abrasive particles 14, including the exemplary quartz, iron or iron-containing materials, and other materials identified previously herein, are commercially available.

As depicted in FIG. 1, supporting substrate 12 comprises a planar member embedded with abrasive particles 14. As shown, some abrasive particles 14 protrude from a conditioning surface 16 of supporting substrate 12. As abrasive particles 14 at conditioning surface 16 are worn down or break away from supporting substrate 12, conditioning surface 16 is preferably also worn, thereby exposing other abrasive particles 14 that are more deeply embedded within supporting substrate 12. Accordingly, supporting substrate 12 is preferably formed from a material that will wear during conditioning of a CMP pad when exposed to friction from the CMP pad or by the abrasion of abrasive particles 14 that break away from conditioner 10. For example, supporting substrate 12 may be formed from a polymer or combination of polymers that is as soft as or softer than the type of CMP pad to be conditioned with conditioner 10. Supporting substrate 12 is, preferably, also substantially rigid or includes a rigid backing so as to impart planarity to a polishing surface of a CMP pad as the CMP pad is conditioned therewith.

Conditioner 10 may be formed by dispersing a quantity of abrasive particles 14 in an at least partially unconsolidated (e.g., molten, liquid, or particulate or powdered) quantity of material providing a matrix for supporting substrate 12. The mixture of supporting substrate 12 material and abrasive particles 14 is then formed into a solid mass. The desired shape for conditioner 10 may be obtained by use of known molding (e.g., injection molding) or casting processes, as well as by cutting a larger, solid volume of abrasive particle 14 impregnated supporting substrate 12 material into the desired shape. A conditioning surface 16 of supporting substrate 12 may be treated prior to use in conditioning so that abrasive particles 14 at least partially protrude therefrom. Of course, such treatment of conditioning surface 16 may be effected by removing material of supporting substrate 12 from conditioning surface 16. Such removal may be carried out by use of known chemicals or chemical mixtures (e.g., hydrofluoric acid, potassium hydroxide, sodium hydroxide, hydrochloric acid, etc.) that will degrade or dissolve the material of supporting substrate 12 without substantially degrading or dissolving abrasive particles, or that at least degrade or dissolve the material of supporting substrate 12 at a faster rate than the rate at which the material or materials of abrasive particles 14 are degraded or dissolved by the chemicals. Alternatively, such removal may be effected mechanically, such as by frictional contact.

Another exemplary method for forming conditioner 10 includes providing a quantity of at least partially unconsolidated supporting substrate 12 material and dispersing abrasive particles 14 onto at least a conditioning surface 16 of the quantity of supporting substrate 12 material. While some of abrasive particles 14 may diffuse into and be completely embedded within the at least partially unconsolidated material of supporting substrate 12, other abrasive particles 14 may remain exposed and partially protrude from conditioning surface 16. As another alternative, abrasive particles 14 may be dispersed onto at least a conditioning surface 16 of a supporting substrate 12 and secured thereto with heat or pressure or a combination thereof. For example, heat from a furnace, lamps, or a laser could be used to melt abrasive particles 14 onto or into conditioning surface 16 so as to secure abrasive particles 14 thereto.

Figure 2:
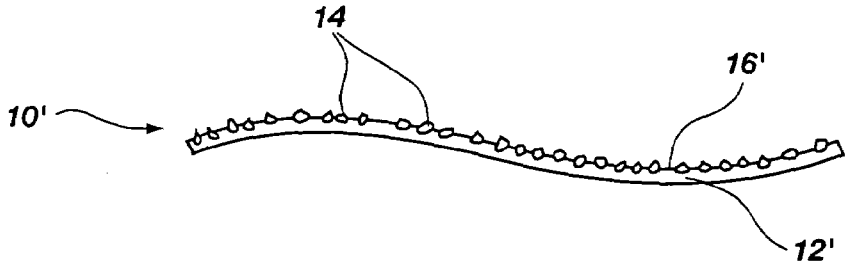
FIG. 2 is a cross-sectional schematic representation of a variation of the conditioner illustrated in FIG. 1, wherein the supporting substrate is pliable.
Figure 2A:
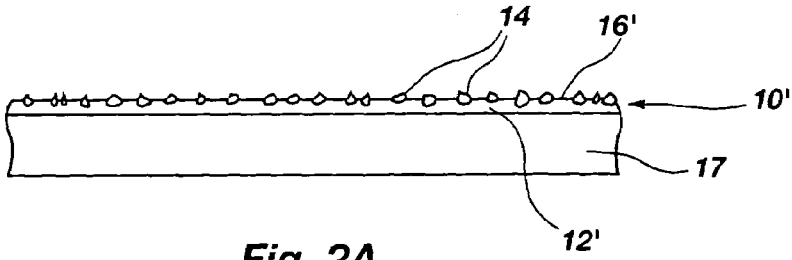
FIG. 2A illustrates the conditioner of FIG. 2 secured to a rigid support.

FIG. 2 illustrates a conditioner 10' including a variation of supporting substrate 12', which comprises a flexible, substantially planar sheet of material, such as a polymer film, paper or a paper-like material (e.g., kraft paper), or cloth. Alternatively, substrate 12' may comprise a flexible mat or mesh formed from metal or polymer. Abrasive particles 14 may be secured to at least a conditioning surface 16' of supporting substrate 12' as explained previously herein, or otherwise, as known in the art. Supporting substrate 12' may alternatively be embedded with abrasive particles 14. For example, when supporting substrate 12' is a polymer film, a mixture of supporting substrate 12' material and abrasive particles 14 may be formed as described previously herein. The mixture is then formed into a film by processes that are known in the relevant art. When paper or a paper-like material is used as supporting substrate 12', pulp may similarly be mixed with abrasive particles 14, then formed into a sheet, as known in the art of paper-making. A cloth supporting substrate 12' may also be embedded with abrasive particles 14, as known in the relevant art. As illustrated in FIG. 2A, conditioner 10', or any other embodiment of a conditioner incorporating teachings of the present invention and, particularly, embodiments that are not self-supporting, may be secured to a rigid support 17.

Figure 3:
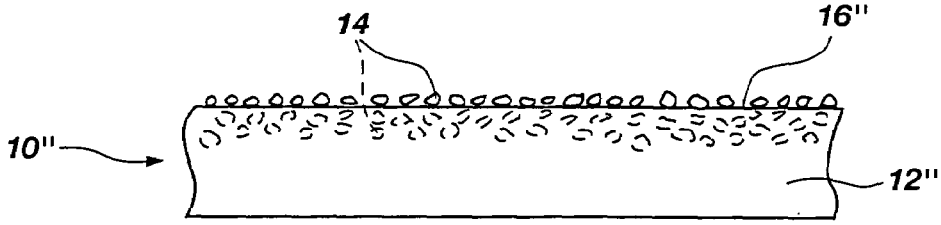
FIG. 3 is a cross-sectional schematic representation of another variation of the conditioner illustrated in FIG. 1, including a rigid supporting substrate of, for example, metal or ceramic.

A conditioner 10" with another variation of supporting substrate 12" is depicted in FIG. 3. Supporting substrate 12" is a solid, rigid fixture that includes a conditioning surface 16" to which abrasive particles 14 are exposed. Supporting substrate 12" may be fabricated from any suitable rigid, tough, material, such as a metal (e.g., steel, aluminum, etc.), ceramic, or the like. Abrasive particles 14 may be secured to conditioning surface 16" of supporting substrate 12" by any known method, such as by sintering. Alternatively, supporting substrate 12" may be formed, as known in the art (e.g., by casting) with abrasive particles 14 embedded therein. When supporting substrate 12" of conditioner 10" is at least partially embedded with abrasive particles 14, abrasive particles 14 that originally underlie conditioning surface 16" may be exposed as previously exposed abrasive particles 14 are worn or break away from conditioner 10" and as conditioning surface 16" of conditioner 10" wears.

Figure 4:
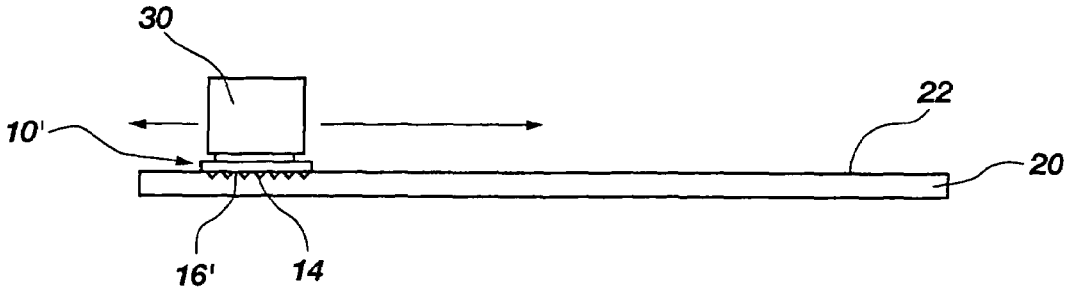
FIG. 4 schematically illustrates use of a conditioner to condition a polishing pad in accordance with the invention.

With reference to FIG. 4, a conditioner 10' (FIG. 2) of the present invention may be used to condition a polishing surface 22 of a CMP pad 20 by bringing conditioning surface 16' of conditioner 10' into contact with polishing surface 22. One or both of conditioner 10' and CMP pad 20 are moved, or dragged, relative to each other so as to create friction between conditioning surface 16' and polishing surface 22. Such movement may be effected, for example, by rotating, vibrating, or laterally moving one or both of conditioner 10' and CMP pad 20 relative to the other. Appropriate, known apparatus 30 may be employed to effect such movement. For example, conditioner 10' may be secured to a rotary, or orbital, sander, a belt sander, or a vibratory sander of a known type to effect conditioning of CMP pad 20.

As friction is created by movement of one or both of conditioner 10' and CMP pad 20, abrasive particles 14 exposed to conditioning surface 16' of conditioner 10' abrade, or wear, polishing surface 22 of CMP pad 20, conditioning polishing surface 22 by providing same with desired characteristics, including, without limitation, texture, roughness, and planarity. The friction between conditioning surface 16' of conditioner 10' and polishing surface 22 of CMP pad 20, as well as the presence of abrasive particles 14 that have broken away from conditioner 10', may cause conditioner 10' to wear. If conditioner 10' is at least partially impregnated below the initially exposed layer of abrasive particles 14 with additional abrasive particles 14, abrasive particles 14 may continue to be exposed and, thus, to effect the conditioning process of the present invention as conditioner 10' wears.

While FIG. 4 and the accompanying description are illustrative of a conditioning process that includes use of a specific type of conditioner 10' according to the present invention, the conditioning process may similarly be effected with conditioners 10 (FIG. 1) and 10" (FIG. 3), as well as with other conditioners incorporating teachings of the present invention.

Figure 5:
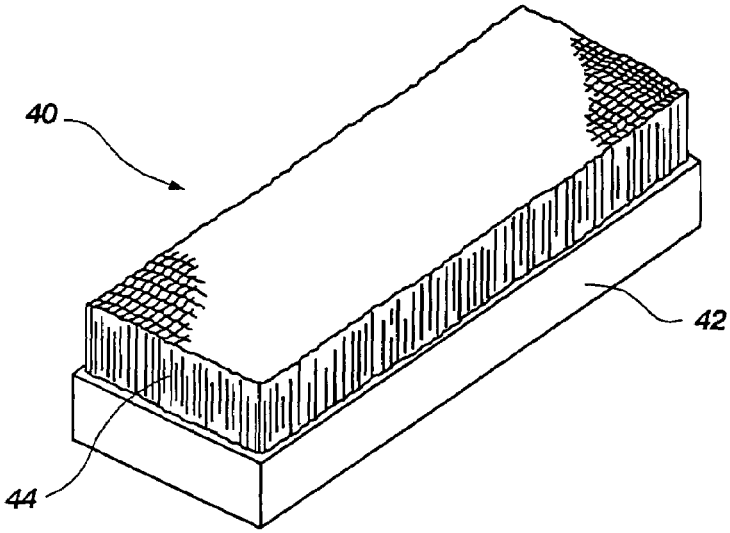
FIG. 5 is a perspective view of another embodiment of conditioner that may be used to effect the method of the present invention.

FIG. 5 illustrates another embodiment of a conditioner 40 that is useful for conditioning a CMP pad in accordance with teachings of the present invention. Conditioner 40 is a brush that includes a support structure 42 and filaments 44, or bristles or wires, of an abrasive material that may be dissolved or degraded by chemicals (e.g., wet etchants) that will not substantially degrade or damage a type of CMP pad to be conditioned with conditioner 40. As the abrasive material of conditioner 40 is in the form of filaments 44, the abrasive material is also preferably a ductile material, such as, without limitation, iron or an iron-containing material (e.g., steel or an iron alloy such as INVAR®), copper, nickel, tungsten, or another metal. As noted previously herein, iron and iron-containing materials may be degraded or dissolved by hydrochloric acid, which will not substantially degrade or dissolve materials, such as polyurethane, that are conventionally used to form CMP pads. Other metals may similarly be degraded or dissolved by appropriate chemicals (e.g., acids) or chemical combinations (e.g., acids and oxidants).

Conditioner 40 bearing filaments 44 may be used similarly to abrasive particles 14 of conditioners 10, 10', and 10" to condition a CMP pad, as described previously herein with reference to FIG. 4.

Figure 5A:
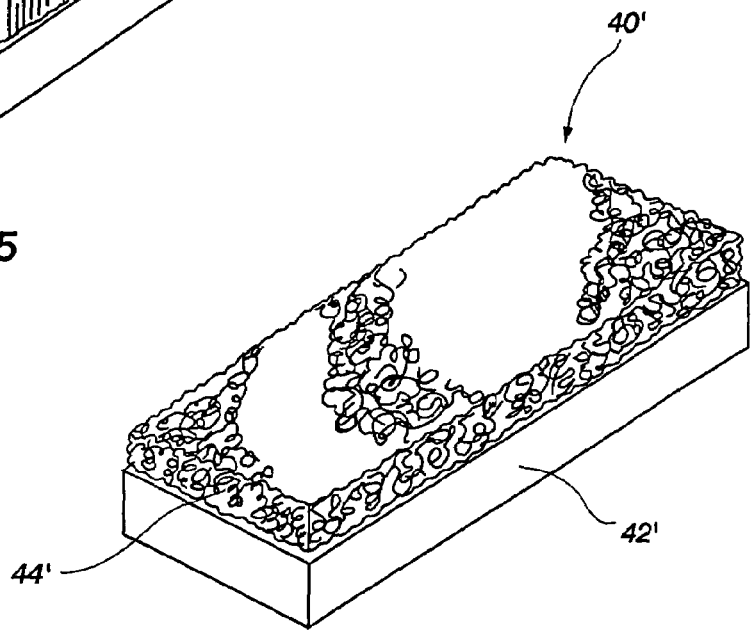
FIG. 5A is a perspective view of a variation of the embodiment of the conditioner shown in FIG. 5.

As shown in FIG. 5A, a variation of conditioner 40' includes twisted or curled filaments 44' of an abrasive material, such as iron or an iron-containing material (e.g., steel), copper, nickel, tungsten, or another metal. For example, conditioner 40' may include steel wool. The abrasiveness of conditioner 40' depends, in part, upon the density, weave, and thickness, or gauge, of filaments 44'. As illustrated, filaments 44' may be secured to a support structure 42'.

Figure 6:
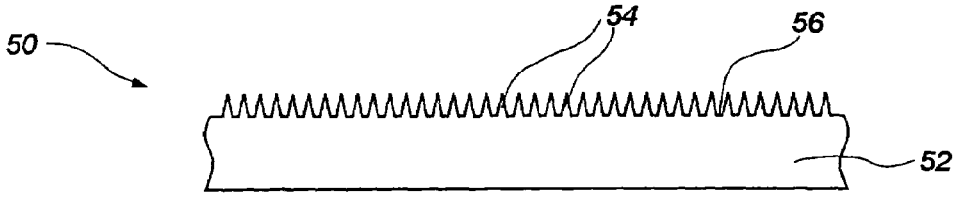
FIG. 6 is a cross-sectional schematic representation of yet another embodiment of a conditioner according to the present invention.

FIG. 6 depicts another embodiment of conditioner 50 incorporating teachings of the present invention and that is useful in methods and systems of the present invention. Conditioner 50 includes a base 52, or supporting substrate, and abrasive elements 54 integral or continuous with a conditioning surface 56 of base 52 and protruding therefrom. Base 52 and abrasive elements 54 may be formed from the same material or different materials. Abrasive elements 54 are formed from a material, such as crystalline silicon dioxide or a metal such as iron, an iron-containing material, copper, nickel, tungsten, etc., that may be dissolved or degraded by chemicals that will not substantially degrade or damage a type of CMP pad to be conditioned with conditioner 50 and may be fabricated by use of known processes. For example, abrasive elements 54 may be fabricated by use of known mask and isotropic or anisotropic etch techniques, depending upon the desired abrasive element shape, similar to those known in the art of field emission tip fabrication, to form abrasive elements 54. Exemplary configurations of abrasive elements 54 that may be formed by employing such processes include substantially prismatic, substantially cylindrical, substantially conical, and substantially pyramidal. When abrasive elements 54 are formed from crystalline silicon dioxide, any known silicon dioxide wet or dry etchant may be used. Similarly, when abrasive elements 54 are formed from a metal or metal alloy, such as iron or an iron-containing material, chemicals, such as hydrochloric acid, that etch through these materials may be used.

Alternatively, abrasive elements 54 may be formed by known mechanical machining processes or by lathing.

Figure 7:
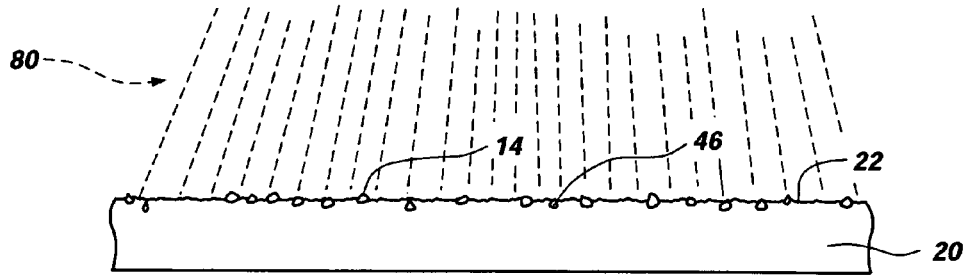
FIG. 7 is a schematic representation of a process of removing abrasive from a polishing pad in accordance with teachings of the present invention.

As abrasive particles 14 (FIGS. 1–3) or debris 46 (FIG. 7) from filaments 44 (FIG. 5) or from abrasive elements 54 (FIG. 6) may be loosened from conditioner 10, 10', 10", 40 during use thereof to condition polishing surface 22 of CMP pad 20 (FIG. 4), abrasive particles 14 or debris 46 may stick to polishing surface 22 of CMP pad 20 or become embedded or entrapped within CMP pad 20, as shown in FIG. 7. These abrasive particles 14 or debris 46 may be substantially removed from CMP pad 20 at the conclusion of the conditioning operation by exposing CMP pad 20, along with abrasive particles 14 or debris 46, thereon to a chemical 80 or mixture of chemicals that will degrade or dissolve abrasive particles 14 or debris 46 at a faster rate than chemical 80 or a mixture of chemicals will degrade or dissolve the material or materials of CMP pad 20 and without significantly changing the surface features, texture, or roughness of polishing surface 22 of CMP pad 20. Preferably, chemical 80 or a mixture of chemicals that is used to remove abrasive particles 14 or debris 46 from CMP pad 20 will do so without substantially degrading or dissolving the material or materials of CMP pad 20. As indicated previously herein, when abrasive particles 14 include quartz, or crystalline silicon dioxide, chemical 80 may include, without limitation, hydrofluoric acid, sodium hydroxide, or potassium hydroxide. If a hydrofluoric acid solution is used, the hydrofluoric acid preferably makes up at least about 5% of the solution. If abrasive particles 14 or debris 46 comprise iron or an iron-containing material, chemical 80 may include, without limitation, hydrochloric acid.

Although FIG. 7 illustrates exposing CMP, pad 20, along with abrasive particles 14 and debris 46 on and embedded or entrapped within polishing surface 22 thereof, to chemical 80 by way of spraying chemical 80 onto at least a portion of CMP pad 20, such exposure to chemical 80 may alternatively be effected by immersing CMP pad 20, or at least a portion of polishing surface 22 thereof, in chemical 80 or otherwise, as known in the art.

The rate of degradation or dissolution of abrasive particles 14 or debris 46 in chemical 80 may be accelerated, as may the dislodging of abrasive particles 14 or debris 46 from polishing surface 22, by sonicating (i.e., sonically vibrating) chemical 80 by known processes as chemical 80 contacts abrasive particles 14 or debris 46.

Figure 8:
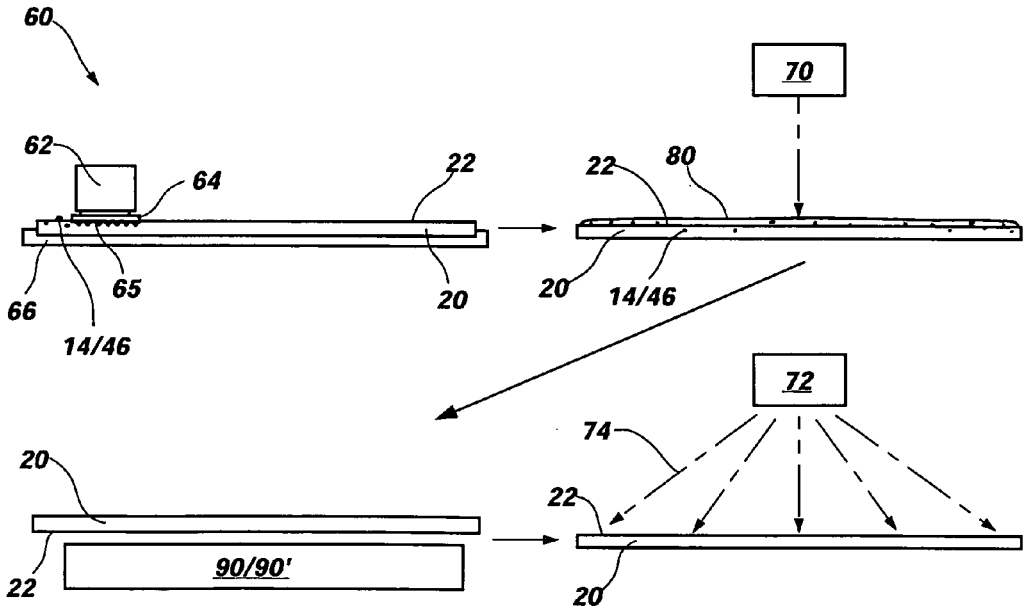
FIG. 8 schematically depicts a conditioning system for effecting the method of the present invention.

With reference to FIG. 8, an exemplary conditioning system 60 that may be used to effect the methods of the present invention is shown. Conditioning system 60 includes a conditioner movement component 62 that moves a conditioner 64, such as conditioners 10, 10', 10", 40, and 50 described previously herein, relative to a CMP pad 20 that is secured to a platen 66, or polishing pad support. Conditioner movement component 62 is configured to position a conditioning surface 65 of conditioner 64 against a polishing surface 22 of CMP pad 20 and to drag conditioning surface 65 across polishing surface 22, such as by rotation, vibration, or substantially linear movement. Platen 66 holds CMP pad 20 in a fixed position relative to conditioner 64. In addition to the movement of conditioner 64 effected by conditioner movement component 62, platen 66 and CMP pad 20 secured thereto may be moved relative to conditioner 64 so as to further effect dragging of conditioning surface 65 across at least a portion of polishing surface 22. Alternatively, platen 66 may move CMP pad 20, while conditioner 64 is held substantially stationary.

Once CMP pad 20 has been conditioned in accordance with the method of the present invention, abrasive particles 14 or other debris 46 are removed from CMP pad 20 by exposing at least polishing surface 22 of CMP pad 20 to chemical 80. Accordingly, conditioning system 60 includes a chemical source 70 that is configured to apply chemical 80 to CMP pad 20. Chemical source 70 may be of any type known in the art and include, for example, an applicator, such as a spray head or a roller, for applying chemical 80 to CMP pad 20, or a chemical bath into which CMP pad 20 may be at least partially disposed. Chemical source 70 may be of any type known in the art and include, for example, an applicator, such as a spray head or a roller, for applying chemical 80 to CMP pad 20, or a chemical bath into which CMP pad 20 may be at least partially disposed.

Figure 9:
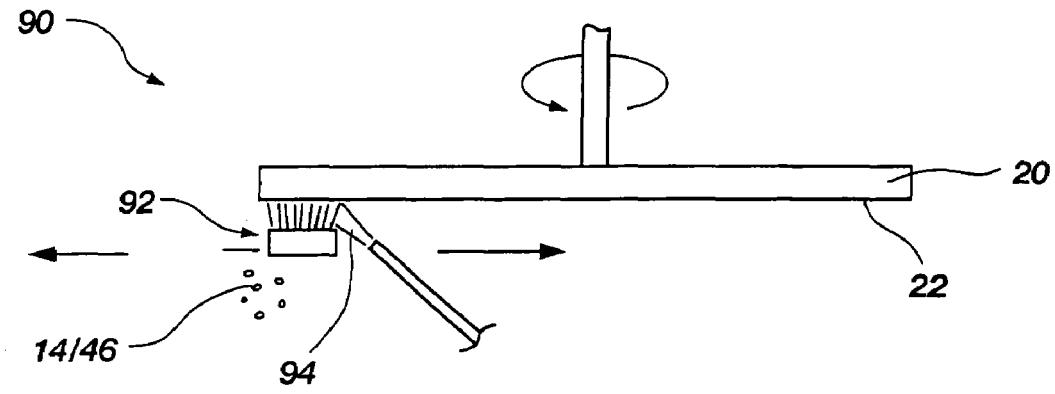
FIG. 9 schematically depicts an embodiment of a physical abrasive removal component useful in the conditioning system of FIG. 8.

In addition, conditioning system 60 may include a physical abrasive removal component 90, 90'. As shown in FIG. 9, one embodiment of a physical abrasive removal component 90 includes a brush 92 configured to sweep across polishing surface 22 of CMP pad 20 as CMP pad 20 is rotated. Physical abrasive removal component 90 may also include a spray 94 of chemical 80 or of a rinsing liquid, which may also facilitate the removal of abrasive particles 14 or debris 46 from polishing surface 22. Brush 92 and spray 94 may be laterally translatable relative to polishing surface 22 of CMP pad 20. Accordingly, physical abrasive removal component 90 may physically remove abrasive particles 14 or debris 46 from at least polishing surface 22 of CMP pad 20 as abrasive particles 14 or debris 46 are being degraded or dissolved by chemical 80. In addition, if polishing surface 22 faces downwardly, abrasive particles 14 or debris 46 removed therefrom would fall away from CMP pad 20, thereby further facilitating removal of abrasive particles 14 or other debris 46 from CMP pad 20.

Figure 10:
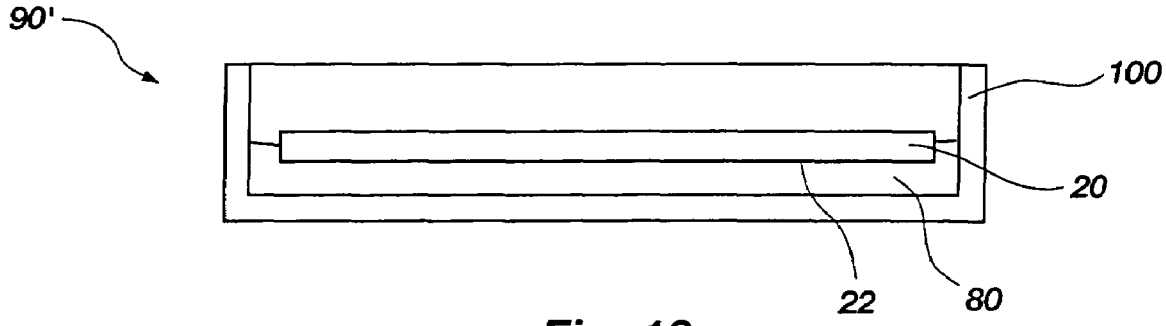
FIG. 10 schematically depicts another embodiment of a physical abrasive removal component useful in the conditioning system of FIG. 8.

Alternatively, as shown in FIG. 10, physical abrasive removal component 90' may comprise an ultrasonic bath 100 of chemical 80. As at least a polishing surface 22 of CMP pad 20 is disposed in ultrasonic bath 100, CMP pad 20 and chemical 80 are sonicated and abrasive particles 14 or other debris 46 are removed from CMP pad 20 during degradation or dissolution of abrasive particles 14 or other debris 46. As CMP pad 20 is disposed in ultrasonic bath 100 with polishing surface 22 facing downward, gravity further facilitates the removal of abrasive particles 14 or other debris 46 from CMP pad 20.

Referring again to FIG. 8, conditioning system 60 may also include a rinsing component 72 for disposing a rinse liquid 74, such as pure water, onto at least polishing surface 22 of CMP pad 20 so as to substantially remove chemical 80 therefrom.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions and modifications to the invention as disclosed herein which fall within the meaning and scope of the claims are to be embraced thereby.

What is claimed is:

1. A method for fabricating an apparatus for conditioning a polishing pad, comprising:
   selecting an abrasive material that is degradable or dissolvable by at least one chemical that does not substantially degrade or dissolve a material of a polishing pad to be conditioned with the apparatus;
   providing a quantity of the abrasive material comprising abrasive particles;
   completely embedding at least some of the abrasive particles within a supporting substrate; and
   forming a conditioning surface on the supporting substrate that includes at least a portion of the quantity of abrasive material, the conditioning surface including a plurality of abrasive elements and configured to condition a polishing pad for use in semiconductor device fabrication processes.

2. The method of claim 1, wherein providing the support substrate comprises providing at least one of a polymer, a metal, a ceramic, paper, a paper-like material, or a fabric.

3. The method of claim 1, wherein providing abrasive particles comprises providing abrasive particles having a dimension of about 25 μm to about 500 μm.

4. The method of claim 1, wherein providing abrasive particles comprises at least partially impregnating the supporting substrate with the abrasive particles.

5. The method of claim 4, wherein at least partially impregnating comprises disposing at least some of the abrasive particles adjacent the conditioning surface.

6. The method of claim 1, wherein forming the conditioning surface comprises securing at least some of the abrasive particles to a surface of the supporting substrate.

7. The method of claim 1, further comprising:
   forming a supporting substrate from the quantity of abrasive material.

8. The method of claim 1, wherein providing the quantity of abrasive material comprises forming a layer of the abrasive material on a supporting substrate.

9. The method of claim 1, wherein forming the conditioning surface comprises patterning the abrasive material.

10. The method of claim 9, wherein patterning the abrasive material comprises:

forming a mask including apertures therethrough over the abrasive material; and contacting regions of the abrasive material exposed through the mask to an etchant to at least partially remove the regions through the mask.

11. The method of claim 1, wherein providing the quantity of the abrasive material comprises providing a quantity of at least one of silicon dioxide, iron, an iron alloy, copper, nickel, and tungsten.

12. The method of claim 1, wherein forming the conditioning surface comprises securing filaments comprising the abrasive material to a supporting substrate.

13. The method of claim 12, wherein securing filaments comprises securing substantially linear filaments to the supporting substrate.

14. The method of claim 13, wherein securing substantially linear filaments comprises securing the substantially linear filaments in substantially parallel relation to one another.

15. The method of claim 12, wherein securing filaments comprises securing at least one curled or twisted filament to the supporting substrate.

16. The method of claim 12, wherein securing filaments comprises forming a brush.

17. The method of claim 16, wherein securing filaments comprises securing filaments comprising a ductile material to the supporting substrate.

18. The method of claim 16, wherein securing filaments comprises securing filaments comprising at least one of iron, an iron alloy, copper, nickel, and tungsten to the supporting substrate.

19. The method of claim 12, wherein securing filaments comprises securing filaments comprising a ductile material to the supporting substrate.

20. The method of claim 12, wherein securing filaments comprises securing filaments comprising at least one of iron, an iron alloy, copper, nickel, and tungsten to the supporting substrate.

21. A method for fabricating an apparatus for conditioning a polishing pad, comprising:

selecting an abrasive material that is degradable or dissolvable by at least one chemical that does not substantially degrade or dissolve a material of a polishing pad to be conditioned with the apparatus;

providing a quantity of the abrasive material; and forming a conditioning surface that includes at least a portion of the quantity of abrasive material, the conditioning surface including a plurality of abrasive elements and configured to condition a polishing pad for use in semiconductor device fabrication processes; and patterning the abrasive material, including:

forming a mask including apertures therethrough over the abrasive material; and contacting regions of the abrasive material exposed through the mask to an etchant to at least partially remove the regions through the mask.

22. The method of claim 21, further comprising:

providing a supporting substrate.

23. The method of claim 22, wherein providing the supporting substrate comprises providing at least one of a polymer, a metal, a ceramic, paper, a paper-like material, or a fabric.

24. The method of claim 22, wherein providing the quantity of the abrasive material comprises providing abrasive particles.

25. The method of claim 24, wherein providing abrasive particles comprises providing abrasive particles having a dimension of about 25 μm to about 500 μm.

26. The method of claim 24, wherein providing abrasive particles comprises at least partially impregnating the supporting substrate with the abrasive particles.

27. The method of claim 26, wherein at least partially impregnating comprises disposing at least some of the abrasive particles adjacent the conditioning surface.

28. The method of claim 27, wherein forming the conditioning surface comprises securing at least some of the abrasive particles to a surface of the supporting substrate.

29. The method of claim 22, wherein providing the quantity of abrasive material comprises forming a layer of the abrasive material on the support substrate.

30. The method of claim 21, wherein providing the quantity of the abrasive material comprises providing a quantity of at least one of silicon dioxide, iron, an iron alloy, copper, nickel, and tungsten.

31. The method of claim 21, further comprising:

securing filaments comprising the abrasive material to the supporting substrate.

32. The method of claim 31, wherein securing filaments comprises securing substantially linear filaments to the supporting substrate.

33. The method of claim 32, wherein securing substantially linear filaments comprises securing the substantially linear filaments in substantially parallel relation to one another.

34. The method of claim 31, wherein securing filaments comprises securing at least one curled or twisted filament to the supporting substrate.

35. The method of claim 31, wherein securing filaments comprises forming a brush.

36. The method of claim 35, wherein securing filaments comprises securing filaments comprising a ductile material to the supporting substrate.

37. The method of claim 35, wherein securing filaments comprises securing filaments comprising at least one of iron, an iron alloy, copper, nickel, and tungsten to the supporting substrate.

38. The method of claim 31, wherein securing filaments comprises securing filaments comprising a ductile material to the supporting substrate.

39. The method of claim 31, wherein securing filaments comprises securing filaments comprising at least one of iron, an iron alloy, copper, nickel, and tungsten to the supporting substrate.

40. A method for fabricating an apparatus for conditioning a polishing pad, comprising:

providing a quantity of an abrasive material that is degradable or dissolvable by at least one chemical that does not substantially degrade or dissolve a material of a polishing pad to be conditioned with the apparatus;

forming a supporting substrate from the quantity of abrasive material; and forming a conditioning surface on the supporting substrate, the conditioning surface including at least a portion of the quantity of abrasive material and a plurality of abrasive elements and configured to condition a polishing pad for use in semiconductor device fabrication processes.

41. The method of claim 40, wherein providing the quantity of the abrasive material comprises providing abrasive particles.

42. The method of claim 41, wherein providing abrasive particles comprises providing abrasive particles having a dimension of about 25 μm to about 500 μm.

43. The method of claim 40, wherein providing the quantity of abrasive material further includes forming a layer of the abrasive material on the supporting substrate.

44. The method of claim 40, wherein forming the support substrate includes patterning the conditioning surface.

45. The method of claim 44, wherein patterning the supporting substrate comprises:

forming a mask including apertures therethrough over the conditioning surface; and contacting regions of the conditioning surface exposed through the mask to an etchant to at least partially remove the regions through the mask.

46. The method of claim 45, wherein providing the quantity of the abrasive material comprises providing a quantity of at least one of silicon dioxide, iron, an iron alloy, copper, nickel, and tungsten.

47. The method of claim 40, further comprising:

securing filaments comprising the abrasive material to the supporting substrate.

48. The method of claim 47, wherein securing filaments comprises securing substantially linear filaments to the supporting substrate.

49. The method of claim 48, wherein securing substantially linear filaments comprises securing the substantially linear filaments in substantially parallel relation to one another.

50. The method of claim 47, wherein securing filaments comprises securing at least one curled or twisted filament to the supporting substrate.

51. The method of claim 47, wherein securing filaments comprises forming a brush.

52. The method of claim 51, wherein securing filaments comprises securing filaments comprising a ductile material to the supporting substrate.

53. The method of claim 51, wherein securing filaments comprises securing filaments comprising at least one of iron, an iron alloy, copper, nickel, and tungsten to the supporting substrate.

54. The method of claim 47, wherein securing filaments comprises securing filaments comprising a ductile material to the supporting substrate.

55. The method of claim 47, wherein securing filaments comprises securing filaments comprising at least one of iron, an iron alloy, copper, nickel, and tungsten to the supporting substrate.

* * * * *